US005895190A

United States Patent [19]

Viola

[11] Patent Number: 5,895,190

[45] Date of Patent: Apr. 20, 1999

[54] COMB FOR BINDING DOCUMENTS CONSTITUTED BY SHEETS PERFORATED ALONG ONE EDGE

[75] Inventor: Marta Emanuela Viola, Milan, Italy

[73] Assignee: Prima S.r.l., Milan, Italy

[21] Appl. No.: 08/963,073

[22] Filed: Nov. 3, 1997

[30] Foreign Application Priority Data

Nov. 13, 1996 [IT] Italy ..... MI96A2357

[51] Int. Cl.[6] ..... B42B 9/00

[52] U.S. Cl. ..... 412/40; 412/38

[58] Field of Search ..... 412/38, 40; 402/8, 402/60

[56] References Cited

U.S. PATENT DOCUMENTS 2,206,394 7/1940 Farkas .
5,051,050 9/1991 Scharer ..... 412/40
5,527,142 6/1996 Chih-Kwo ..... 412/38
5,683,218 11/1997 Mori ..... 412/40

FOREIGN PATENT DOCUMENTS 2 340 828 9/1977 France .
2230822 9/1978 Germany ..... 412/40

*Primary Examiner*—Willmon Fridie, Jr.
*Attorney, Agent, or Firm*—Guido Modiano; Albert Josif

[57] ABSTRACT

A comb for binding documents constituted by sheets perforated along one edge, comprising a strip of material in sheet form which has, along one edge, a plurality of comb-like tabs which can be inserted in corresponding holes formed along the edge of sheets that constitute a document to be bound and are longer than the document is thick. The strip has a width which allows folding on the spine of the document and overlapping on the portion of the tabs protruding from the holes. There is also provided an adhesive layer which affects at least the region where the strip and the portion of the tabs that protrudes from the holes mutually overlap.

7 Claims, 3 Drawing Sheets

COMB FOR BINDING DOCUMENTS CONSTITUTED BY SHEETS PERFORATED ALONG ONE EDGE

BACKGROUND OF THE INVENTION

The present invention relates to a comb for binding documents constituted by sheets perforated along one edge.

Conventional plastic combs are currently used to bind documents constituted by sheets perforated along one edge with substantially elongated rectangular holes; said combs substantially have a cylindrical shape formed by a strip-like portion, at the edge whereof there protrude tabs which are arranged in a comb-like fashion and can be inserted in the holes, in practice by opening out the cylindrical shape of the comb. The tabs are arranged at their free end below the strip-like portion, so as to obtain an element which mutually joins the various sheets of the documents This solution has the drawback that it has a comb which protrudes with respect to the thickness of the document, so that in many cases it is difficult to position it correctly in a bookshelf or the like.

Moreover, in order to achieve good binding it is necessary that a wide range of combs sizes are available so as to adapt to the different thicknesses of the document.

A problem which is becoming increasingly felt relates to the disposal of the document, since a comb made of plastics is used and accordingly must be separated again from the document when the latter must be discarded Other conventional solutions achieve binding of documents by means of combs provided with adhesive material which, generally by applying heat, melts at the spine of the documents, thus providing a coupling element.

With respect to the previous solution, this solution has the advantage that it does not produce thicknesses which protrude with respect to the thickness of the document and therefore it allows easier arrangement in a bookshelf and the like, but on the other hand it does not allow to easily modify the composition of the document if required, since removal of the comb is destructive.

Still another problem is constituted by the fact that the coupling that is ensured is often rather weak, so that it is necessary to resort to metal staples or other elements to join the sheets to each other beforehand, thus constituting a hindrance when turning over the pages of the document.

SUMMARY OF THE INVENTION

The aim of the present invention is to eliminate the above drawbacks, by providing a comb for binding documents constituted by sheets perforated along one edge which allows to avoid creating thicknesses that protrude with respect to the thickness of the document constituted by perforated sheets to be bound.

Within the scope of this aim, a particular object of the present invention is to provide a comb which, by being producible even by using paper-like material, can be discarded without having to be separated from the documents.

Another object of the present invention is to provide a comb which allows to separate the sheets of the document even after application, since it does not destroy the document when the comb is removed.

Another object of the present invention is to provide a comb which, in view of its particular constructive characteristics, is capable of giving the greatest assurances of reliability and safety in use.

Another object of the present invention is to provide a comb which can be easily obtained starting from commonly commercially available elements and materials and is also competitive from a purely economical point of view.

This aim, these objects and others which will become apparent hereinafter are achieved by a comb for binding documents constituted by sheets perforated along one edge, according to the present invention, characterized in that it comprises a strip of material in sheet form which has, along one edge, a plurality of comb-like tabs which can be inserted in corresponding holes formed along the edge of sheets that constitute a document to be bound and are longer than said document is thick, said strip having a width which allows folding on the spine of said document and overlapping on the portion of said tabs that protrude from said holes, an adhesive layer being also provided which affects at least the region where said strip and said portion of said tabs that protrude from said holes mutually overlap.

BRIEF DESCRIPTION OF THE DRAWINGS

Further characteristics and advantages of the present invention will become apparent from the following detailed description of a preferred but not exclusive embodiment of a comb for binding documents constituted by sheets perforated along one edge, according to the invention, illustrated only by way of non-limitative example in the accompanying drawings, wherein.

DESCRIPTION OF THE PREFERRED EMBODIMENTS

Figure 1:
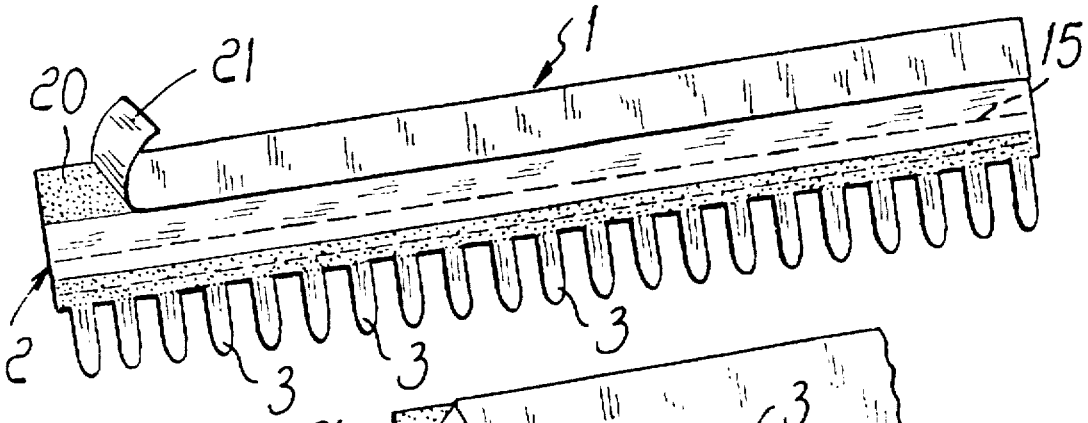
FIG. 1 is a schematic perspective view of the comb according to the invention, extended flat.

With reference to the above figures, the comb for binding documents constituted by sheets perforated along one edge, according to the present invention, generally designated by the reference numeral 1, is constituted by a strip 2 made of material in sheet form, which is preferably but not necessarily made of paper-like material and has, at one edge, a plurality of tabs 3 which are arranged in a comb-like configuration and can be inserted in the holes 4 of a document generally designated by the reference numeral 5.

Figure 2:
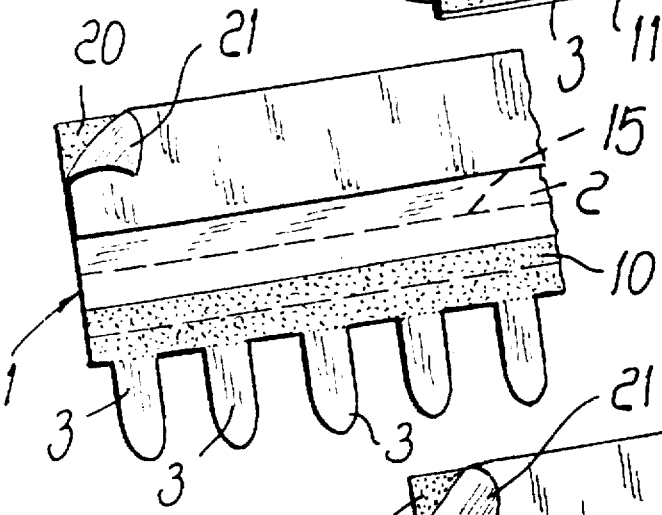
FIGS. 2 and 3 are views, in enlarged scale with respect to FIG. 1, of a portion of combs having different widths according to the different thicknesses of the documents to be bound.
Figure 3:
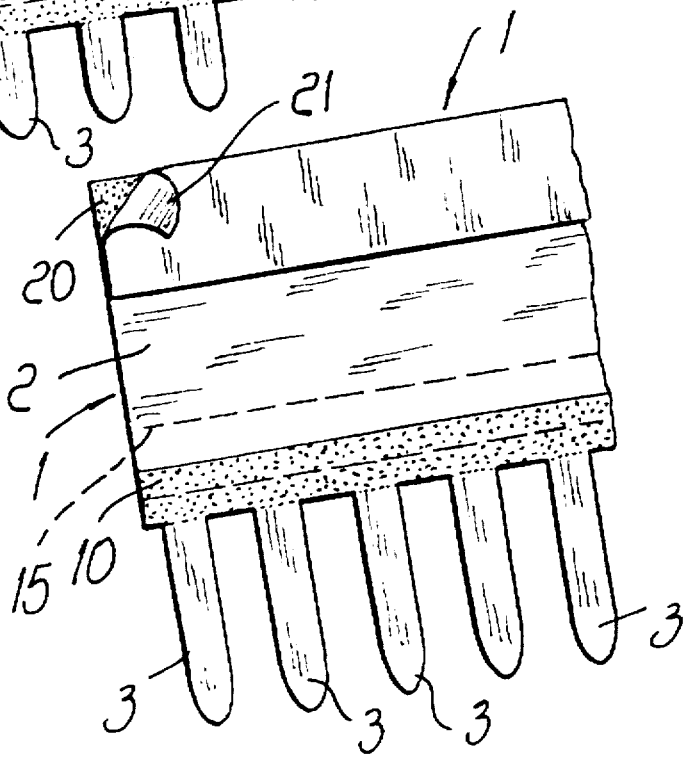
Figure 5:
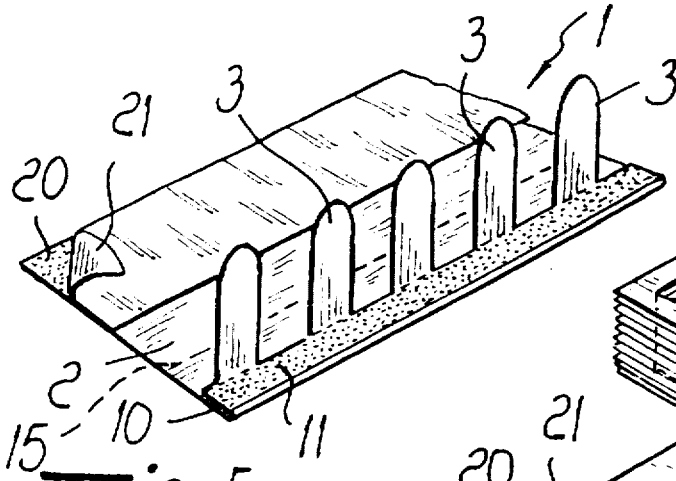
FIG. 5 is a perspective view of the comb with its tabs folded for insertion in the holes.
Figure 6:
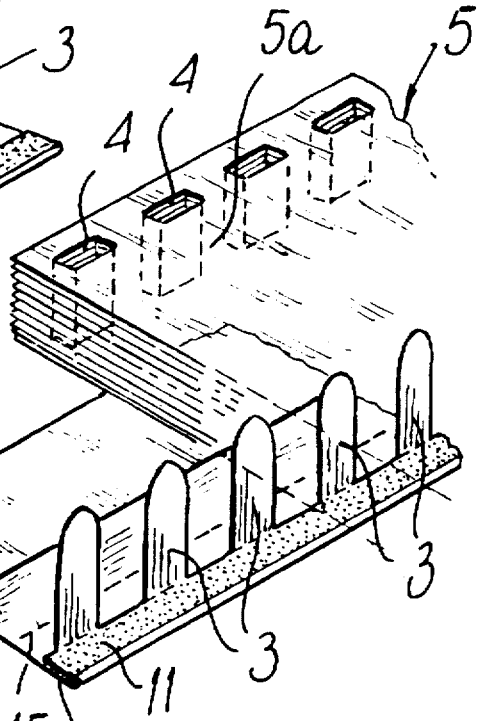
FIG. 6 is a schematic exploded perspective view of the step for the insertion of the tabs in the holes.

As shown in FIGS. 1 to 3, the comb can be provided with different widths and with corresponding different tab lengths, so that it can adapt to documents having different thicknesses; it should be noted that an increase in the width of the strip 2 is matched by a similar increase in the length of the tabs.

Figure 4:
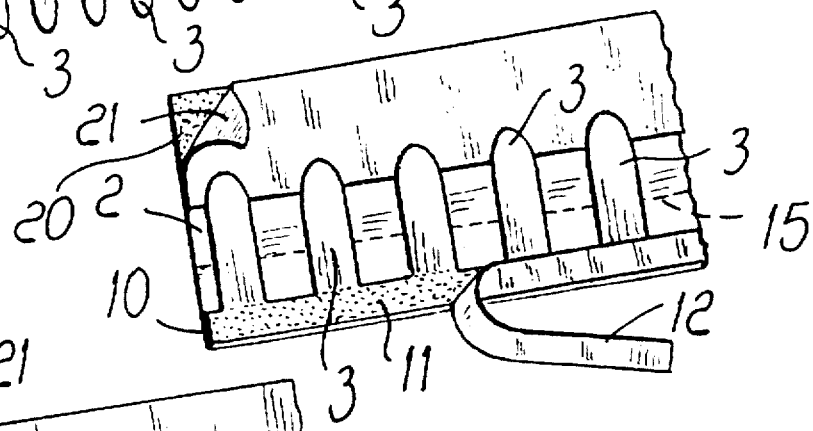
FIG. 4 is a schematic view of the comb with its tabs folded onto the strip and with the elements for protecting the adhesive materials partially removed.

In order to allow to conceal the region affected by holes 4 at the cover, there is provided a folding portion 10 at the edge from which the tabs 3 protrude; an adhesive layer is interposed thereat and provides an overlap shown more clearly in FIG. 4.

Figure 7:
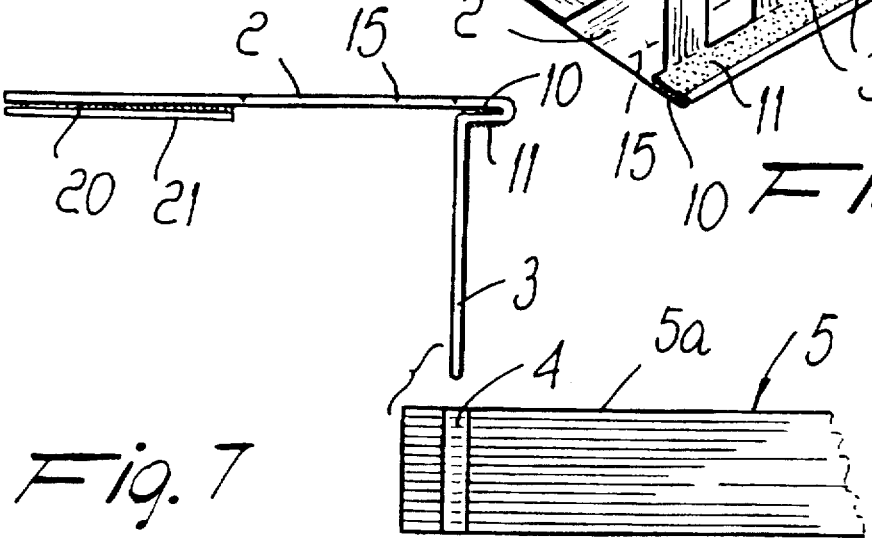
FIG. 7 is an exploded elevation view of the insertion of the tabs in the holes.
Figure 8:
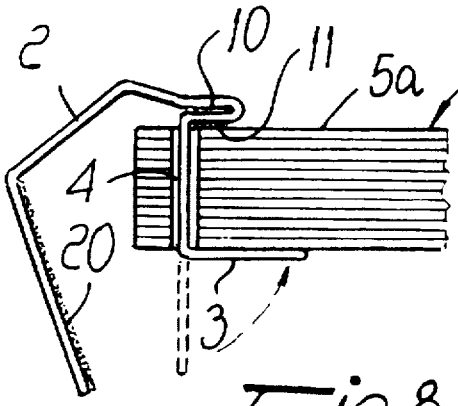
FIG. 8 is a view of the step for folding the portion of the tabs that protrudes from the holes and of the step for folding the comb.
Figure 9:
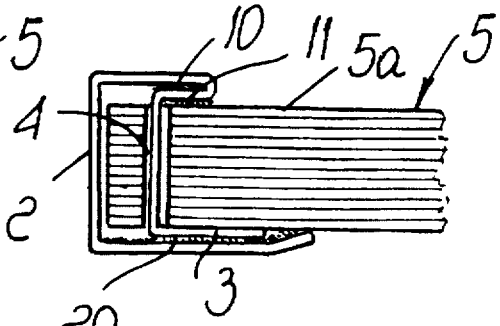
FIG. 9 is a view of the comb folded onto the document, shown spaced in order to clearly illustrate its shape.
Figure 10:
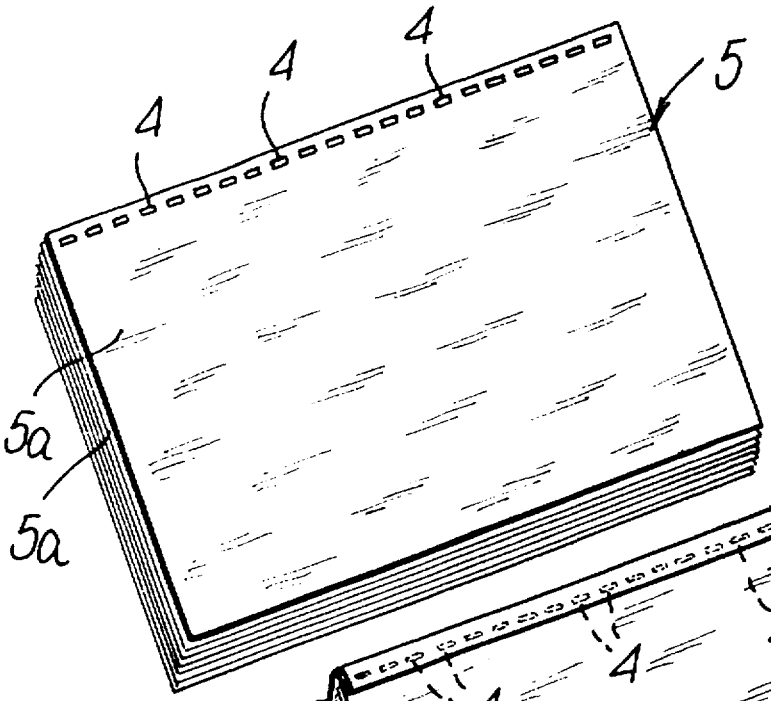
FIG. 10 is a schematic perspective view of a document with sheets perforated along one edge.
Figure 11:
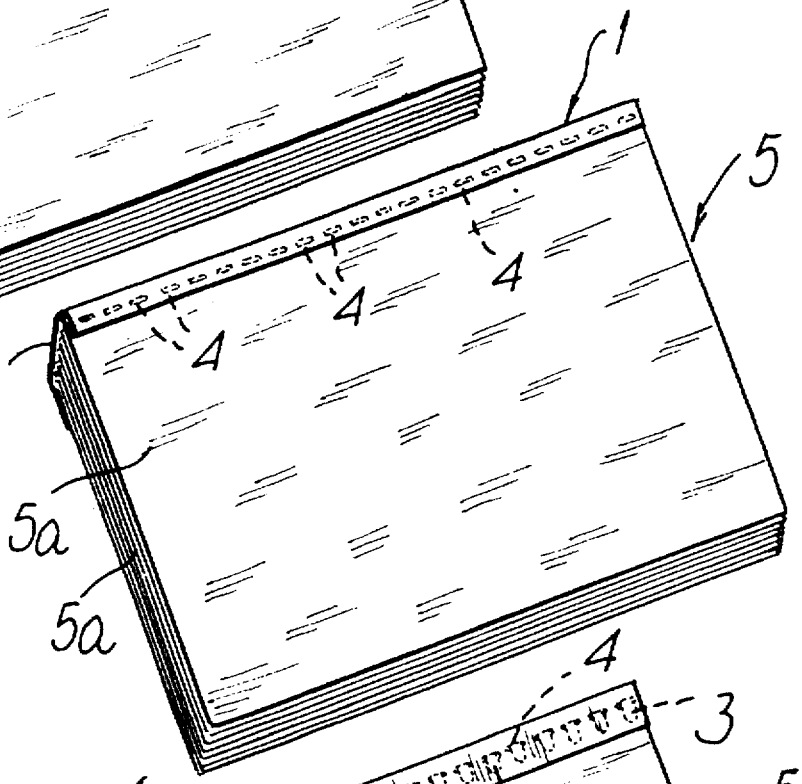
FIG. 11 is a perspective view of the bound document, seen from the front cover.
Figure 12:
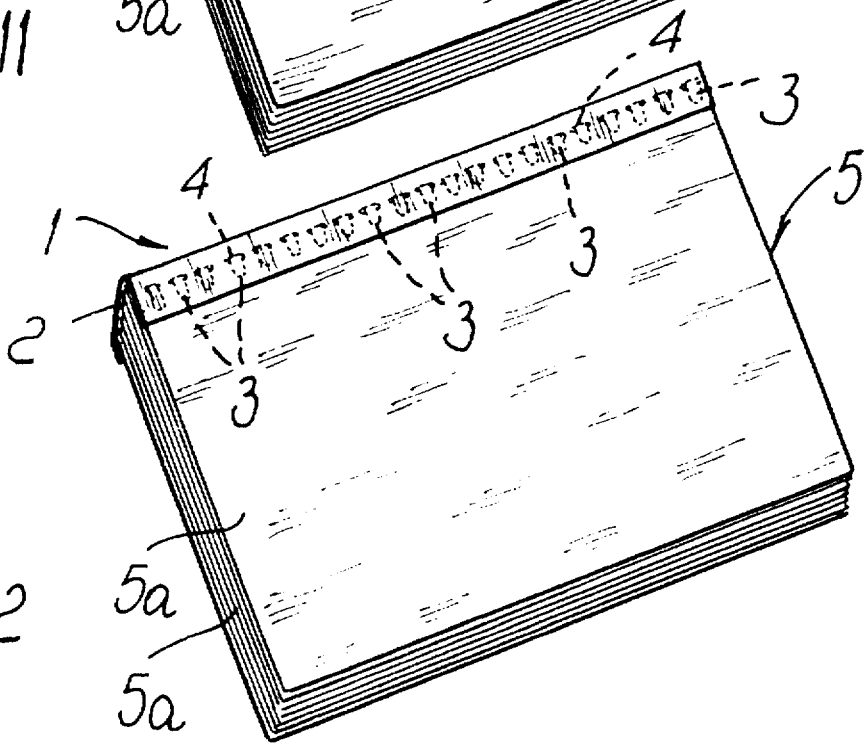
FIG. 12 is a perspective view of the bound document, seen from the back cover.

In practice, therefore, a covering border is formed by folding the strip and is arranged above the holes 4, as shown in FIGS. 7 to 9.

Moreover, advantageously there is provided an external layer of adhesive 11 at the covering border, which makes the covering border adhere to the cover 5*a* of the document, thus providing a stable coupling in this region.

Optionally, there is provided a strip 12 for protecting the external adhesive 11 which can be removed upon application to the document.

The strip 2 has a width which allows to fold it on the spine of the document and allows it to overlap the portion of the tabs 3 that protrudes from the holes 4 at the face of the document that lies opposite to the one where insertion in the holes occurs.

The tabs that protrude from the holes 4 are folded towards the free edge of the document and are fixed by means of the overlap of the edge of the strip that is opposite to the edge provided with the tabs.

For this purpose, an adhesive layer, designated by the reference numeral 20, is provided on the edge of the strip and can be of the self-adhesive type, in which case it is protected by a protective strip 21, or can be of the heat-activated type or of another kind.

The adhesive material adheres to the tab portions that protrude from the holes 4 and to the back cover part of the document, i.e., to the last sheet, thus achieving a stable coupling.

It should be added that the strip advantageously has a scoring line, designated by the reference numeral 15, which facilitates the folding of the strip at the cover, in relation to the fact that the distance between the holes and the edge is constant and accordingly the first fold can be preset; it is also possible to provide other scoring lines in order to facilitate folding at the back cover according to the thickness of the document; folding is thus obtained by simply bending the strip and is very easy, since the strip is preferably made of paper-like material.

It is evident, from the above description, that the present invention achieves the intended aim and objects and in particular the fact is stressed that a comb for binding documents constituted by sheets perforated along one edge is provided which allows to mutually joint the sheets easily, without generating extra thicknesses with respect to the thickness of the document; moreover, the resulting comb does not occupy space in storage, differently from what is achieved with currently used cylindrical plastic combs.

The comb can also act as a seal of guarantee, for example by signing or marking it; such a seal does not allow to add sheets to the document unless said comb is removed and destroyed, thus damaging the signature or marking.

Another important aspect is also constituted by the fact that the comb as described above can be made of paper-like material and that accordingly it is not necessary to separate it when the document must be destroyed.

The invention thus conceived is susceptible of numerous modifications and variations, all of which are within the scope of the inventive concept.

All the details may also be replaced with other technically equivalent elements.

In practice, the materials employed, as well as the contingent shapes and dimensions, may be any according to requirements.

What is claimed is:

1. A comb for binding documents constituted by sheets perforated along one edge, comprising a strip of material in sheet form having, along one edge, a plurality of comb-like tabs which can be inserted in corresponding holes formed along the edge of sheets that constitute a document to be bound and are longer than said document is thick, said strip having a width which allows folding on the spine of said document and overlapping on at least one portion of said tabs that protrude from said holes, an adhesive layer being also provided which affects at least the region where said strip and said portion of said tabs that protrude from said holes mutually overlap.

2. A comb according to claim 1, wherein said strip has, at the edge affected by said tabs, a folding portion in order to provide a border for covering said holes of said document, said folding portion being affected by an adhesive layer.

3. A comb according to claim 2, comprising an external layer of adhesive which is provided at the border for covering in order to produce the adhesion of said border to a cover of the document to be bound.

4. A comb according to claim 1, further comprising a strip for protecting the adhesive layer which can be removed upon application.

5. A comb according to claim 1, further comprising a layer of adhesive on said strip at the edge which lies opposite to the one affected by said tabs.

6. A comb according to claim 5, wherein said layer of adhesive is of the self-adhesive type with a removable protective strip.

7. A comb according to claim 1, further comprising at least one scoring line for folding said strip at the edge of a front cover and/or of a back cover of the document to be bound.

* * * * *